United States Patent [19]

Bailey

[11] Patent Number: 4,473,167

[45] Date of Patent: Sep. 25, 1984

[54] CONTAINER LID CONSTRUCTION

[76] Inventor: John A. Bailey, 1679 Trapelo Rd., Waltham, Mass. 02154

[21] Appl. No.: 428,357

[22] Filed: Sep. 29, 1982

Related U.S. Application Data

[63] Continuation-in-part of Ser. No. 363,892, Mar. 30, 1982, , which is a continuation-in-part of Ser. No. 839,445, Oct. 5, 1977, Pat. No. 4,322,015, which is a continuation of Ser. No. 647,212, Jan. 7, 1976, abandoned, which is a continuation-in-part of Ser. No. 538,535, Jan. 6, 1975, abandoned.

[51] Int. Cl.[3] ..... A47G 19/22

[52] U.S. Cl. ..... 220/90.4; 220/254; 220/269; 229/7 R

[58] Field of Search ..... 220/90.2, 90.4, 90.6, 220/266, 268, 269, 355, 254; 229/7 R, 43; 222/541, 556; 215/253, 254

[56] References Cited

U.S. PATENT DOCUMENTS

| | | | |
|---|---|---|---|
| 3,994,411 | 11/1976 | Elfelt et al. | 229/43 X |
| 4,056,210 | 11/1977 | Boyle | 229/7 R X |
| 4,090,660 | 5/1978 | Schram | 229/43 |
| 4,113,135 | 9/1978 | Yamazaki | 215/253 X |
| 4,202,459 | 5/1980 | DeParales | 229/7 R X |
| 4,322,015 | 3/1982 | Bailey | 220/269 X |

*Primary Examiner*—Steven M. Pollard

[57] ABSTRACT

There is disclosed a polymeric container lid construction whereby the contents of a container equipped therewith can be readily accessed by means of a reclosable access strip defined between a pair of spaced apart tear impressions extending inwardly from the edge of the lid and into the central portion thereof. An improved self-forming hinge element for the access strip is described along with an improved hold-open retainer construction by which the access strip can be releasably retained in the open condition.

9 Claims, 4 Drawing Figures

CONTAINER LID CONSTRUCTION

CROSS-REFERENCES TO RELATED APPLICATIONS

This application is a continuation-in-part of my copending application Ser. No. 363,892, filed Mar. 30, 1982; said application Ser. No. 363,892 being a continuation-in-part of application Ser. No. 839,445, filed Oct. 5, 1977, now U.S. Pat. No. 4,322,015; said application Ser. No. 839,445 being a continuation of application Ser. No. 647,212, filed Jan. 7, 1976, abandoned; and said application Ser. No. 647,212 being a continuation-in-part of application Ser. No. 538,535, filed Jan. 6, 1975, abandoned.

FIELD OF THE INVENTION

The present invention relates generally to container lids and is more particularly concerned with container lids formed of thin, resilient, thermoplastic polymeric sheet materials and of the type conventionally employed as temporary closures for food and beverage containers.

In my previously identified applications there are disclosed container lids composed of a thin, resilient, thermoplastic polymeric sheet material and comprising a relatively flat central portion of a size and shape to overlie the open end of a cup or container and a peripheral rim-engaging means adapted to releasably secure the lid to the container rim. My previously disclosed container lid constructions also include a pair of spaced apart tear impressions extending inwardly from the edge of the lid, said impressions terminating within the central portion at separate, spaced apart tear stop means, thereby to define between said impressions an access strip. Upon opening of the access strip there self-forms a hinge zone between the separate tear stop means. This general construction provides the user with the ability to conveniently access the contents of a container equipped therewith, such as for drinking purposes, while preserving the ability to reclose the access strip to the container rim. Additionally disclosed in my aforementioned applications are hold-open retainer constructions comprising one or more protuberances or depressions on the central portion of the cup lid, which protuberances or depressions are adapted to releasably capture and retain the access strip in the open condition. In accordance with the present invention, I have now discovered certain improvements pertaining to container lids of the foregoing type.

OBJECTS OF THE INVENTION

It is a principal object of the present invention to provide a novel container lid construction.

It is another object of the invention to provide an improved container lid composed of a thin resilient thermoplastic polymeric material and comprising an access strip having an improved self-forming hinge construction therefor.

It is another object of the invention to provide an improved container lid composed of a thin resilient thermoplastic polymeric material and comprising an access strip having an improved self-forming hinge construction therefor along with an improved hold-open retainer means.

Other objects and advantages of the present invention will in part be obvious and will in part appear hereinafter.

SUMMARY OF THE INVENTION

In accordance with the invention, the container lid hereof is composed of a thin, resilient thermoplastic sheet material and comprises a central portion of a size and shape adapted to overlie the open end of a container and an integral rim-engaging means disposed around the periphery of said central portion, said rim-engaging means being adapted to releasably secure said lid to a container rim. An access strip is defined by a pair of spaced apart tear impressions extending inwardly from the edge of the lid and into the central portion thereof and a self-forming hinge construction therefor is defined by a molded-in depression on said central portion, said depression defining an essentially vertical, straight, depending wall extending transversely of and bridging the interior ends of said tear impressions. In another important embodiment of the invention said depression is of a size and shape to provide a wall opposite said straight vertical wall, said opposite wall being adapted to act as a retainer for the access strip and to releasably capture and retain that portion of the rim-engaging means carried by the opened access strip.

DESCRIPTION OF THE PREFERRED EMBODIMENTS

Figure 1:
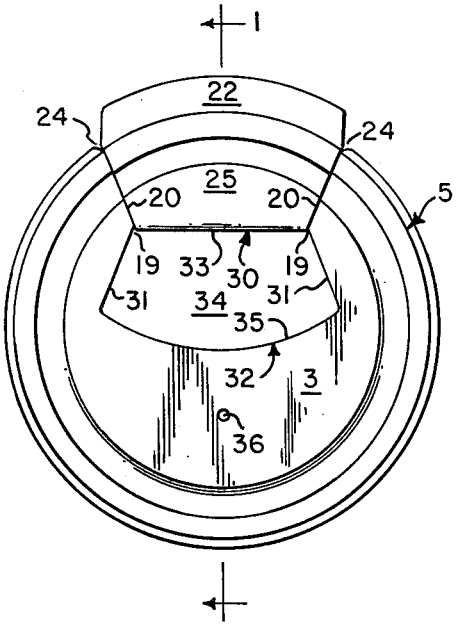
FIG. 1 is a schematic, diagrammatic, top plan view of a container lid in accordance with the invention.
Figure 2:
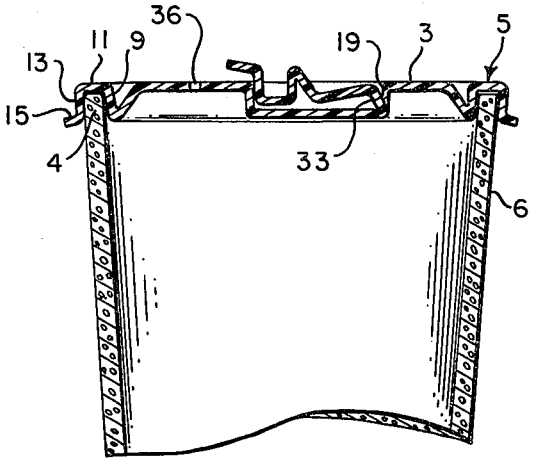
FIG. 2 is a schematic, diagrammatic, sectional view of the container lid of FIG. 1 taken through lines 1—1' thereof and showing the access strip 25 releasably captured in the open condition by the retainer construction of the invention.

Referring now to FIGS. 1 and 2 hereof, wherein like reference numerals refer to like structures, the container lid of the invention is thermoformed of a thin sheet-form resilient thermoplastic polymeric material such as polystyrene, polyethylene, polypropylene, cellulose nitrate, acrylonitrile-butadiene-styrene copolymer, polyvinylacetate, polyvinylbutyral, polyvinylchloride, cellulose acetate, cellulose acetate butyrate and the like. Polystyrene compositions have found favor in the fabrication of food and beverage container lids by reasons of their good thermoforming properties, relative inertness to foodstuffs and good economics. Accordingly, polymeric materials composed of polystyrene and copolymers comprising at least about 90 percent by weight of styrene monomer component represent preferred materials of construction.

The container lid of the present invention broadly comprises a relatively flat central portion 3 of a size and shape to overlie the open end of a container 6 and a rim-engaging means 5 integral with and surrounding the periphery of said central portion 3. The function of said rim-engaging means 5 is, of course, to releasably secure the lid to the rim 4 of container 6. Accordingly, the rim-engaging means 5 will usually comprise an inverted channel structure defined by a generally ascending internal wall element 9 integral with the perimeter of the central portion 3, a transverse arch element 11 integral with and extending outwardly from the ascending wall element 9 and a descending exterior wall element 13 integral with and descending from the exterior periphery of the transverse arch element 11. In order to promote facility in removing the lid completely from the container rim 4, the lower edge 15 of the descending wall element 13 is desirably projected at least somewhat outwardly from the remainder of said wall element 13. Completing the general construction of the lid there is usually provided on central portion 3 a vent aperture 36.

Access strip 25 comprises a pair of spaced apart tear impressions 20 which extend inwardly from the edge 15 and each of which impressions 20 terminate at spaced apart locations within the central portion 3 of the lid. It is the role of the tear impressions 20 to preordain and direct the tearing failure of the polymeric material of construction along the pathways defined thereby. Accordingly, said impressions 20 may each be molded, embossed or scored as a single continuous line into the surface of the lid or, in accordance with the embodiment shown in FIGS. 3 and 4, can each be performed as a plurality of spaced apart, relatively short impressions 20'. Referring to FIGS. 1–4, it is preferred that the exterior ends of impressions 20 or 20' each be faulted substantially completely through the polymeric material of construction, thereby to facilitate initiation of the tears along the tear impressions. Said faults can conveniently take the form of a slit or notch 24 or 24' located at the exterior end of each said impression 20 or 20'.

Referring again to the embodiment of the invention depicted in FIGS. 1 and 2, the self-forming hinge element 30 comprises a molded-in depression 32 having an essentially vertical wall 33 which runs transversely of and bridges the interior ends of the tear impressions 20. Said tear impressions 20 can each run to or into the material of the wall 33, thereby to assure rupture of the polymeric material of said wall 33 at the internal ends of impressions 20 upon tearing back of the access strip 25 to its open condition. Precise definition of the hinge points for access strip 25 can be even further assured when the vertical wall 33 is faulted completely through the polymeric material of construction at the internal ends of the tear impressions 20, such as by slits 19.

In a preferred embodiment of the invention the pair of tear impressions 20 are convergent and the molded-in depression 32 comprises divergent side walls 31. Utilizing this preferred geometry of these elements it is in the nature of things that a tear stop is inherently provided at the common juncture of each impression 20 with its corresponding vertical wall 33 and side wall 31. This is so because the tearing of sheet form polymeric materials of the type conventionally employed in the fabrication of container lids tends to propogate along the plane of orientation of the material. Where, as in this preferred construction, the plane of orientation of the material is sharply and angularly altered, a tear stop is inherently provided at the junction of the disparate planes of orientation.

In another preferred embodiment of the invention depression 32 is of a size and shape as to provide a wall 35 opposite vertical wall 33 of hinge element 30 and a pair of side walls 31 running between said vertical wall 33 and wall 35, said side walls 31 and wall 35 cooperating to releasably capture and retain that portion of the rim-engaging means 5 carried by the opened access strip 25. As best shown in the top plan view of FIG. 1, wall 35 is shaped so as to correspond to and provide the mirror contour of the portion of the rim-engaging means 5 carried by access strip 25. Desirably, the sizing and/or geometries of the rim-engaging means 5, said wall 35 and said side walls 31 will be selected such that, with the access strip 25 in the open position and with that portion of the rim-engaging means 5 carried thereby captured by the combination of said wall 35 and side walls 31, the edge portion of said captured portion will remain spaced sufficiently above the central portion 3 as to be readily manipulatable by the user. This can be achieved, for instance, by forming wall 35 of lesser height than the height of said rim-engaging means 5. Where an extended edge section 22 extends from said edge portion 15, this attribute can also be achieved by suitable spacing of wall 35 from hinge wall 33, thereby to cause biasing of said extended edge section 22 upwardly so as to orient said section 22 at a substantial angle of divergence from the surface of central portion 3 and as may best be seen in FIG. 2.

Figure 3:
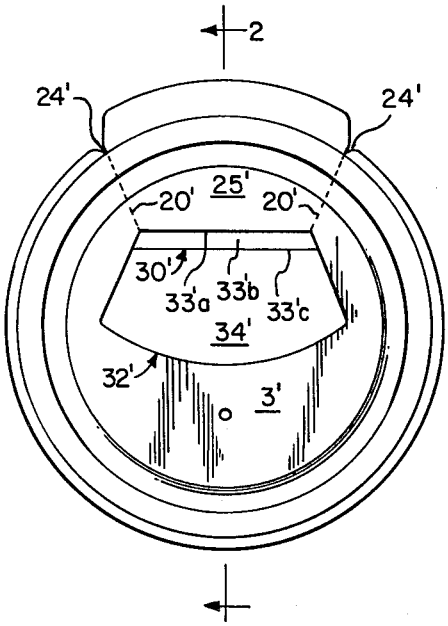
FIG. 3 is a schematic, diagrammatic, top plan view of another container lid in accordance with the invention.
Figure 4:
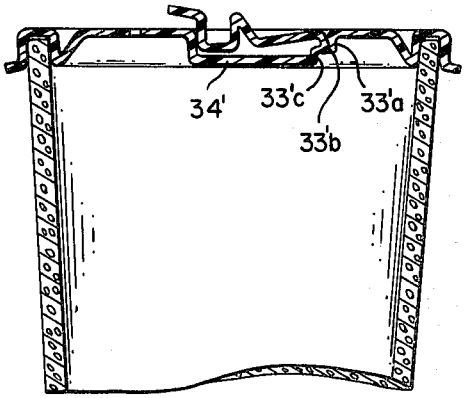
FIG. 4 is a schematic, diagrammatic, sectional view of the container lid of FIG. 3 taken through lines 2—2' thereof and showing the access strip 25' releasably captured in the open condition by the retainer construction of the invention.

In another preferred embodiment of the invention, referring now to FIGS. 3 and 4 hereof, hinge element 30' of molded-in depression 32' is of step form structure and comprises an upper essentially vertical wall riser section 33'(*a*), an essentially horizontal tread section 33'(*b*) and a lower essentially vertical wall riser section 33'(*c*). The upper edge of vertical wall riser section 33'(*a*) is integral with the central portion 3' of the lid while the lower edge of vertical wall riser section 33'(*c*) is integral with the floor 34' of depression 32'. This preferred construction of the hinge element 30' provides for a more gradual bending back of the access strip 25' over a somewhat broader hinge radius and, as best seen in FIG. 4, also beneficially elevates the hinge point to at least somewhat above the floor 34' of depression 32', thereby to further facilitate the bending back of the access strip 25' once the tear impressions 20' have been failed along their respective lengths.

What is claimed is:

1. In a container lid of the type composed of a thin, resilient, thermoplastic polymeric sheet material and comprising a central portion of a size and shape to overlie the open end of a container, a rim-engaging means integral with the periphery of said central portion and being adapted to releasably secure the lid to the rim of a container and a pair of spaced apart tear impressions extending inwardly from the edge of said rim-engaging means and terminating at spaced apart locations within said central portion, thereby to define therebetween an access strip, the improvement which comprises: a self-forming hinge element for said access strip comprising a molded-in depression on said central portion, said depression defining an essentially vertical depending straight wall bridging the interior ends of said tear impressions.

2. The container lid of claim 1 wherein said wall is faulted at the interior end of each said tear impression.

3. The container lid of claim 1 wherein the tear impressions are convergently oriented and wherein said molded-in depression comprises divergently oriented side walls, thereby to define tear stop means at the junction of each said impression with the corresponding side wall and vertical hinge element wall of the depression.

4. The container lid of claim 1 wherein said molded-in depression comprises a wall opposite said straight wall of said hinge element and a pair of spaced apart side walls running between said straight wall and said opposite wall, said opposite wall being shaped to correspond to and define the mirror image contour of the portion of the rim-engaging means carried by said access strip and said opposite wall and said side walls being sized and shaped to releasably capture and maintain said access strip in the open condition.

5. The container lid of claim 4 wherein the height of said opposite wall is sufficiently less than the height of said portion of said rim-engaging means as to maintain the edge of said rim-engaging means at a readily manipulatable height above the surface of said central portion.

6. The container lid of claim 4 wherein the edge of said portion of said rim-engaging means comprises an extended edge section and wherein the spacing of said opposite wall from said straight wall of the hinge element and the geometry thereof are adapted to bias said portion of said rim-engaging means sufficiently as to cause said extended edge section to be carried at a substantially divergent angle relative to said central portion.

7. The container lid of claim 1 wherein the exterior end of each said tear impression is faulted.

8. The container lid of claim 1 wherein said essentially vertical straight wall defining said hinge element is of step form configuration comprising an essentially vertical upper wall riser section extending from said central portion, an essentially horizontal tread section extending from the lower edge of said upper wall riser section and an essentially vertical lower wall riser section extending from the nose of said tread section.

9. The container lid of claim 1 wherein said molded-in depression comprises a wall opposite said depending straight wall of the hinge element and being spaced therefrom, said opposite wall being shaped and spaced from said straight wall of said hinge element as to releasably capture the portion of the rim-engaging means carried by said access strip, thereby to releasably maintain said access strip in the open condition.

* * * * *